United States Patent [19]

Messerschmitt

[11] Patent Number: 4,462,174

[45] Date of Patent: Jul. 31, 1984

[54] PROCESS AND DEVICE FOR THE TREATMENT OF SCREEN PRINT FABRIC

[76] Inventor: Elmar K. Messerschmitt, Paul-Hösch-Strasse 13, 8000 Munich 60, Fed. Rep. of Germany

[21] Appl. No.: 321,133

[22] Filed: Nov. 13, 1981

[30] Foreign Application Priority Data

Nov. 13, 1980 [DE] Fed. Rep. of Germany ..... 3042893

[51] Int. Cl.[3] ..... D06C 3/08

[52] U.S. Cl. ..... 38/102.1; 101/127.1

[58] Field of Search ..... 38/102.1, 102, 70, 102.5, 38/102.8; 26/18.5; 68/DIG. 3 R; 101/127.1, 128, 128.1; 209/403, 365 R, 368

[56] References Cited

U.S. PATENT DOCUMENTS

| | | | |
|---|---|---|---|
| 974,600 | 11/1910 | Robinson | 38/102.8 |
| 1,443,923 | 1/1923 | Nercam | 38/102.8 |
| 1,597,826 | 8/1926 | Reynolds | 68/3 SS |
| 2,016,972 | 10/1935 | Schieferstein | 209/403 |
| 2,730,786 | 1/1956 | Kindstrand et al. | 26/18.5 X |
| 3,875,065 | 4/1975 | Rosenblum | 209/403 X |
| 3,962,805 | 6/1976 | Hamu | 38/102.5 |
| 4,028,230 | 6/1977 | Rosenblum | 101/127.1 X |
| 4,144,660 | 3/1979 | Lamb | 38/102.5 |

*Primary Examiner*—Werner H. Schroeder
*Assistant Examiner*—Andrew M. Falik

[57] ABSTRACT

A process and apparatus for prestretching screen fabric usable in screen printing allows desired screen tension to be achieved rapidly when the screen fabric is inserted into a screen printing frame. The screen fabric is tensioned using a tensioning device, and subsequently an alternating load is applied to the screen fabric to prestretch it. The loading may be applied along a direction parallel to, perpendicular to, or at an intermediate angle to the plane of the screen fabric.

23 Claims, 5 Drawing Figures

FIG. 1
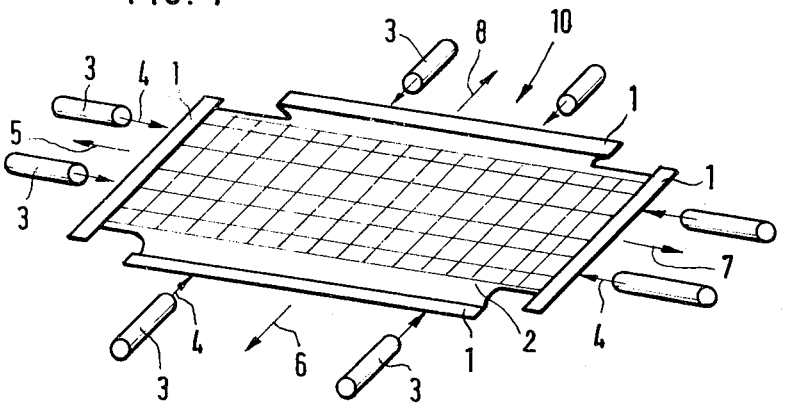
FIG. 2
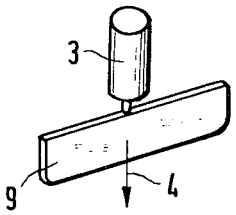
FIG. 3
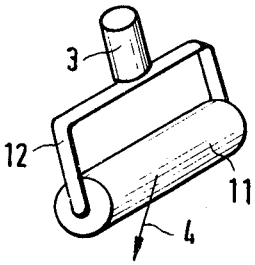
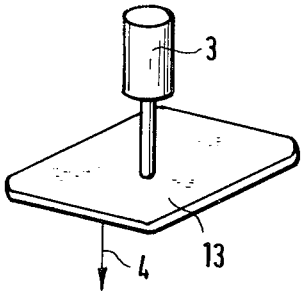
FIG. 4
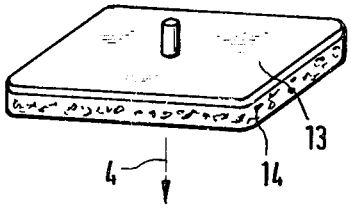
FIG. 5

PROCESS AND DEVICE FOR THE TREATMENT OF SCREEN PRINT FABRIC

The invention relates to a process for the treatment of screen fabric for use in screen printing and to an apparatus for implementation of said process.

In a freshly stretched fabric screen, the tension of the fabric decreases substantially after a period. In the case of fabrics of plastics material this seems to be primarily a process of molecular rearrangement (cold flow). For example, if a polyester screen of size 51×75 cm (120 T format) when not under tension, is stretched to 13 N/cm, the tension decreases within 20 minutes by 1.5 N/cm and within 18 hours by 1.5+2.2 N/cm. This decrease in the tension has the effect that the tensioning process takes a very long time if it is to be carried out with adequate precision. Some time after first stretching, the process must be repeated and possibly again repeated until the alignment or aging process has been reduced to such an extent that relative tensional stability can be expected.

For steel fabrics there is a similar process. This is so-called "air in the cribbing" which can be removed after application of pressure or by overtensioning (which is not always possible), and also by calendering (which is only possible for small items and is very costly).

An object of the present invention is to provide a process and apparatus for the treatment of screen fabric for screen printing wherein the adaptation process of the screen fabric to the desired tension in the fabric frame may be accelerated.

According to one aspect of the invention, there is provided a process for the treatment of screen fabric for use in screen printing wherein an alternating load is applied to the screen fabric with the fabric in a taut condition.

Thus a new type of manufacturing process is proposed, wherein the screen fabric is so to speak prestretched or preaged in order quickly to obtain a precise and reproducibly even tension after being inserted in the screen printing frame.

Thus the present invention concerns a manufacturing process in which an untreated screen fabric is influenced by means of an aging process, so that after final treatment the screen fabric has more precise tension.

The application of an alternating loading to the screen fabric can be effected by various types of processes. A first embodiment provides that the alternating loading acts in the plane of the screen fabric.

A second embodiment provides that the alternating loading acts perpendicularly to the plane of the screen fabric, and a third embodiment provides that the alternating loading acts on the screen fabric at an optional angle between 0° and 90° in relation to the plane of the screen fabric.

There are also various embodiments for the realization of the alternating force which acts upon the screen fabric and loads it in the stretched state.

Such an alternating loading can be created in any manner by a reciprocating tool, and said tool can be driven mechanically, hydraulically or pneumatically.

In a preferred embodiment of the present invention, it is proposed that this alternating loading shoiuld be produced by a vibrator arranged to oscillate ultrasonically.

The ultrasonic vibrator can create a high oscillation frequency (e.g. in the range from 20 to 40 kilohertz) and also sufficiently large oscillation amplitudes are attainable.

An electromechanically driven vibrator could be used to produce alternating loading.

Initial tests have shown that loading of the surface of the screen fabric has more effect than loading of the fabric in its own plane.

In a first embodiment for carrying oiut the process there is provided an apparatus comprising a tensioning device for stretching the screen fabric and at least one vibrator for loading the screen fabric. Here it is left open in what plane these vibrators, which are preferrably ultrasonic vibrators, operate.

Preferably, at least two mutually spaced vibrators are arranged to act parallel to tension bars of the tensioning device in the plane of the screen fabric.

A further embodiment provides that the or each vibrator acts upon a metal wiper, which is movable at an angle of from 0° to 90° to the plane of the screen fabric on the screen fabric.

A further embodiment provides that the or each vibrator acts upon a holder for a roller which can be rolled on the plane of the screen fabric.

Thus a roller shaped structure is formed in which the roller is loaded on its rotational axis with the oscillation amplitude of the oscillator.

It is proposed in a further embodiment that the or each vibrator acts upon a tool surface which can be placed on the screen fabric. It is preferable if that a pressure cushion is arranged between the tool surface and the screen fabric. This pressure cushion can be a plastics foam filled with water or paste or other liquid, but it can also be a pressure cushion filled with air or with a liquid.

All the data and features disclosed in this specification and drawings, especially the three-dimensional arrangement in the drawings, are claimed as important to the invention in so far as they individually or in combination are novel against the prior art.

Below the invention will be explained more fully with reference to drawings showing only a few embodiments. Further features and advantages emerge from the drawings and the specification.

The figures show:

FIG. 1: a schematic view of a tension device in its first embodiment.

FIG. 2: a schematic view of a vibrator in a second embodiment.

FIG. 3: shows a vibrator in a third embodiment.

FIG. 4: shows a vibrator in a fourth embodiment.

FIG. 5: illustrates the working surface of a vibrator with a pressure cushion arranged thereon.

FIG. 1 shows a tensioning device 10 which consists of four mutually spaced frame legs 1 forming a frame. The frame legs are connected to respective edges of the screen fabric. This connection can be made by adhesion, sewing, vulcanizing or by hooking.

A least one vibrator 3 acts upon each of the frame legs. The vibrators are ultrasonic vibrators as illustrated and act in the direction of arrows 4 and in the opposite direction on the respective frame legs. The frame legs 1 are pulled by a tension device (not shown) in the direction of arrows 5, 6, 7 and 8. The whole screen fabric 2 is thus under tension and is loaded by the vibrators 3 with an alternating force in the direction of arrows 4.

Instead of the arrangement of the vibrators parallel to the plane of the screen fabric 2 (as shown in FIG. 1), the device shown in FIG. 2 can be used.

The or each vibrator 3 has a piston rod transferring the oscillation to a metal wiper 9, which vibrates in the direction of arrow 4. The metal wiper is placed perpendicularly or at an angle to the plane of screen fabric 2 within the tension device 10 and moves along the screen fabric.

In another embodiment according to FIG. 3, the vibration is applied to a roller 11. Here the or each vibrator 3 has a piston rod applying oscillation to a holder 12 of roller 11, so that the entire roller 11 oscillates perpendicular to its rotational axis. By placing this roller 11 on the screen fabric 2 within the tension device 10, pre-stressing of the screen fabric 2 is achieved.

FIG. 4 shows another embodiment in which the or each vibrator 3 acts with its piston rod upon a tool having a tool surface 13. This surface 13 vibrates parallel to arrow 4 and is placed on the surface of the screen fabric 2.

According to FIG. 5, on the lower side of the tool surface 13, a pressure cushion 4 can be arranged, which consists of foam, filled with water, dry foam or, alternatively, of a pressure cushion filled with air or a pressure transferring fluid.

But it is also possible to use another exclusively pressure-transferring medium. Such a cushion may produce better transfer of oscillation from surface 13 to the screen fabric 2.

Although the invention has been particularly described with reference to ultrasonic vibrators, it will be understood that the alternating loading applied to the screen material is not necessarily oscillatory in the ultrasonic frequency range. Much slower oscillations, or cyclic loading, may be applicable in certain cases. Heat may be applied to the streen by blowing a hot stream of air onto the screen fabric. Further, liquid may be applied thereto by a spray nozzle or the like. It may also be useful in certain cases to vary the amplitude of vibration of the screen to find an amplitude at which the process is most efficacious.

I claim:

1. A process for prestretching screen fabric usable in screen printing, comprising the steps in order of:

tensioning said screen fabric to be used in screen printing; and applying an oscillatory alternating load to said tensioned screen fabric to prestretch said screen fabric.

2. The process as claimed in claim 1, wherein said oscillatory alternating load is applied at an ultrasonic frequency, said ultrasonic frequency ranging between 20 and 40 kilohertz.

3. The process as claimed in claim 1, wherein said oscillatory alternating load applied to said tensioned screen fabric is applied along a direction parallel to a plane of said screen fabric.

4. The process as claimed in claim 1, wherein said oscillatory alternating load applied to said tensioned screen fabric is applied along a direction perpendicular to a plane of said screen fabric.

5. The process as claimed in claim 1, wherein said oscillatory alternating load applied to said tensioned screen fabric is applied along a direction forming an angle between 0° and 90° relative to a plane of said screen fabric.

6. The process as claimed in claim 1, further comprising the step of applying heat to said tensioned screen fabric in addition to said oscillatory alternating load.

7. The process as claimed in claim 6, further comprising the step of applying liquid to said tensioned screen fabric in addition to said heat and said oscillatory alternating load.

8. An apparatus for prestretching screen fabric usable in screen printing, comprising:

a tensioning device attached to said screen fabric usable for screen printing, said tensioning device tensioning said screen fabric; and at least one vibrator, said vibrator vibrating said screen fabric as it is tensioned by said tensioning device to prestretch said screen fabric.

9. The apparatus as claimed in claim 8, wherein said screen fabric is inserted into a screen printing frame for screen printing subsequent to being prestretched.

10. The apparatus as claimed in claim 8, wherein said vibrator comprises an ultrasonic vibrator.

11. The apparatus as claimed in claim 10, wherein said ultrasonic vibrator vibrates with a frequency ranging between 20 and 40 kilohertz.

12. The apparatus as claimed in claim 11, further comprising an additional vibrator, said vibrators being spaced apart and arranged to vibrate along a direction parallel to tension bars of said tensioning device in a plane of said screen fabric.

13. The apparatus as claimed in claim 11, further comprising a roller, said roller being movable across a surface of said screen fabric and in contact therewith, and a holder for holding said roller, said vibrator vibrating said holder and said roller so that said roller oscillates perpendicular to its rotational axis.

14. The apparatus as claimed in claim 11, further comprising a metal wiper movable between an angle of 0° and 90° relative to a plane of said screen fabric, said metal wiper being in contact with a surface of said screen fabric, said vibrator vibrating said metal wiper.

15. The apparatus as claimed in claim 11, further comprising a tool having a flat surface, said flat surface being in contact with a surface of said screen fabric, a holder for holding said tool, said vibrator vibrating said holder and said tool.

16. The apparatus as claimed in claim 15, wherein said flat surface includes a pressure cushion attached to a lower side thereof which contacts said surface of said screen fabric.

17. The apparatus as claimed in claim 8, wherein said tensioning device includes four mutually spaced frame legs each attached to respective edges of said screen fabric, said frame legs being pulled in differing directions to tension said screen fabric.

18. The apparatus as claimed in claim 8, further comprising an additional vibrator, said vibrators being spaced apart and arranged to vibrate along a direction parallel to tension bars of said tensioning device in a plane of said screen fabric.

19. The apparatus as claimed in claim 8, further comprising a roller, said roller being movable across a surface of said screen fabric and in contact therewith, and a holder for holding said roller, said vibrator vibrating said holder and said roller so that said roller oscillates perpendicular to its rotational axis.

20. The apparatus as claimed in claim 8, further comprising a metal wiper movable between an angle of 0° and 90° relative to a plane of said screen fabric, said metal wiper being in contact with a surface of said screen fabric, said vibrator vibrating said metal wiper.

21. The apparatus as claimed in claim 8, further comprising a tool having a flat surface, said flat surface being in contact with a surface of said screen fabric, a holder for holding said tool, said vibrator vibrating said holder and said tool.

22. The apparatus as claimed in claim 21, wherein said flat surface includes a pressure cushion attached to a lower side thereof which contacts said surface of said screen fabric.

23. The apparatus as claimed in claim 22, wherein said pressure cushion is filled with a pressure transferring medium.

* * * * *